US007491004B2

(12) United States Patent
Kurihara

(10) Patent No.: US 7,491,004 B2
(45) Date of Patent: Feb. 17, 2009

(54) CONTAINER WITH APPLICATOR

(75) Inventor: Mitsuru Kurihara, Sayama (JP)

(73) Assignee: KOSE Corporation, Tokyo (JP)

( * ) Notice: Subject to any disclaimer, the term of this patent is extended or adjusted under 35 U.S.C. 154(b) by 327 days.

(21) Appl. No.: 10/593,070

(22) PCT Filed: Mar. 16, 2005

(86) PCT No.: PCT/JP2005/004629

§ 371 (c)(1),
(2), (4) Date: Sep. 15, 2006

(87) PCT Pub. No.: WO2005/089588

PCT Pub. Date: Sep. 29, 2005

(65) Prior Publication Data

US 2007/0177927 A1 Aug. 2, 2007

(30) Foreign Application Priority Data

Mar. 18, 2004 (JP) ..... 2004-077710

(51) Int. Cl.
*A46B 11/00* (2006.01)

(52) U.S. Cl. ..... 401/122; 401/121; 401/126

(58) Field of Classification Search ..... 401/118, 401/120–122, 126–130; 132/218
See application file for complete search history.

(56) References Cited

U.S. PATENT DOCUMENTS

| | | | | |
|---|---|---|---|---|
| 6,010,266 | A * | 1/2000 | Schrepf | 401/126 |
| 6,142,692 | A * | 11/2000 | Garcia | 401/122 |
| 6,174,099 | B1 * | 1/2001 | Patel et al. | 401/126 |

FOREIGN PATENT DOCUMENTS

| | | |
|---|---|---|
| JP | 58 26408 | 2/1983 |
| JP | 60 33868 | 10/1985 |
| JP | 9 238741 | 9/1997 |
| JP | 2002 209630 | 9/1997 |
| JP | 2003 339436 | 12/2003 |

* cited by examiner

*Primary Examiner*—Tuan N Nguyen
(74) *Attorney, Agent, or Firm*—Oblon, Spivak, McClelland, Maier & Neustadt, P.C.

(57) ABSTRACT

A container with an applicator, which is, although simple in structure, capable of solving a problem of residue adhered to a scraping section ejecting to a mouth of the container. The container with an applicator includes a container body and a lid body having a shaft body at the head of which an applicator is installed. A scraping section is provided on the container body mouth and an annular projection is provided on the shaft body of the lid body. Further, small air circulation holes are provided above and below the annular projection of the shaft body, and the holes enable air to circulate through the inside of the shaft body.

17 Claims, 6 Drawing Sheets

CONTAINER WITH APPLICATOR

TECHNICAL FIELD

The present invention relates to a container with an applicator and, more particularly, to a container with an applicator having a scraping section for removing an excess amount of cosmetic compositions with a certain degree of viscosity such as a paste-like lip gloss, a paste-like lipcolor, mascara, and the like adhering to the applicator, while preventing the content and residue from being ejected due to a pressure change.

BACKGROUND ART

Many makeup cosmetic compositions such as mascara, a liquid eyeliner, a paste-like lipcolor, a paste-like lip gloss, and manicure material have a certain degree of viscosity, because these cosmetic compositions must adhere to eyelashes, the area around the eyes, lips, nails, and the like. In many cases, the products of these cosmetic compositions consist of a cylindrical container containing the composition and a lid equipped with an applicator. Since an excess amount of the composition having a high viscosity frequently adheres to the applicator, many cosmetic containers have a scraping section to remove the excessive composition near the mouth of the container.

However, air circulation between the inside and outside of the container would be inhibited if such a scraping section is provided. A particular problem is ejection of residue produced from the composition adhering to the scraping section from the mouth of the container due to a pressure change caused by inserting the applicator.

An attempt has been made to overcome this problem by appropriately designing or selecting the form and material of the scraping section, appropriately designing the form of the brush shaft attached to the applicator, appropriately adjusting the distance between the scraping section and the brush shaft, and the like. However, it has been difficult to overcome the problem of residue ejection, while satisfying excellent usability.

As one of the means of solving this problem, a method of providing small holes for ventilation on both sides of the scraping section (a sweeping member) has been proposed (e.g. refer to Patent Document 1).

However, providing small holes in the area apart from the center of the scraping section involves a difficult operation requiring a complicated process. This method thus appears to have a problem in practice.

A method of providing a hollow brush shaft and circulating air through the hollow shaft so that there may be no pressure difference between the inside and outside of the container has also been proposed (e.g. Patent Document 2).

The container for viscous solutions proposed in the Patent Document 2 has a long air circulation passage in a hollow brush shaft. A porous material that can adsorb the composition is provided in the lid on the preposition that the composition comes out from the air circulation passage. However, providing a porous material in the lid makes the structure complicated. In addition, pores of the porous material are ultimately filled with the composition and may lose the air circulating function.

Patent Document 1: Japanese Patent Application Laid-open No. 9-238741

Patent Document 2: Examined Utility Model Publication 60-33868

DISCLOSURE OF THE INVENTION

Therefore, development of a container with an applicator having a simple structure which can solve the problem of ejection of residue adhering to a scraping section from the container mouth has been desired.

In order to solve this problem, the present inventor has conducted a study on a container provided with an air circulation passage in the form of a hollow brush shaft shown in the Patent Document 2, in particular. As a result, the present inventor has found that the long air circulation passage does not increase the pressure difference between the inside and outside of the container, which makes it necessary to provide a porous material in the lid of the container. When the lid is opened, the pressure inside the container decreases and power drawing back the composition which once flowed into the air circulation passage to the container should be effective. However, the composition does not completely return to the container when the pressure difference is small. If the composition reflows into the air circulation passage, the remaining composition sequentially moves into the air circulation passage and must ultimately be absorbed by the porous material.

Based on this knowledge, the present inventor has studied the mechanism for drawing back the composition from the air circulation passage to the container without fail when the lid is opened. This study has led to the completion of the present invention.

Specifically, the present invention provides a container with an applicator comprising a container body, a lid body having a shaft body with an applicator provided on the top end thereof, a scraping section provided on the container body mouth, an annular projection provided on the shaft body of the lid body, and small air circulating holes provided above and below the annular projection of the shaft body, enabling air to circulate through the inside of the shaft body.

Since the problem of ejecting a cosmetic composition from the mouth of the container is overcome by using the container with an applicator 1 of the present invention, the container can be safely used for filling viscous cosmetic compositions.

BEST MODE FOR CARRYING OUT THE INVENTION

The present invention will be described in more detail with reference to the drawings showing one embodiment of the container with an applicator.

FIG. 1 is a partially broken view of a (cylindrical) container with an applicator of the present invention, in a state in which the lid is closed. FIG. 2 is a partially broken view of the container in a state in which the lid is being opened. FIG. 3 is a partially broken view of the container in a state in which the lid is being closed. FIG. 4 is a drawing showing a securing part and a shaft body to be fixed to the lid body. In FIG. 1, 1 indicates a container with an applicator, 2 is a container body, 3 is a lid body, 4 is a shaft body, 5 is an applicator, 6 is a scraping section, 7 is an annular projection, 8 is an air circulation holes, 9 is an air circulation section, 10 is a securing part, and A shows a cosmetic composition.

The container body 2 of the container with an applicator 1 of the present invention is a slim cylinder, with a scraping section 6 provided inside the mouth on the upper part. The opening at the top end of the container body 2 is maintained airtight by sealing.

On the other hand, the lid of the container with an applicator 1 comprises the lid body 3 and the shaft body 4 secured to the lid body 3 via the securing part 10. The shaft body 4 is provided with an applicator 5 (a brush is schematically shown in the Figures) on the tip thereof. The hand side of the shaft body 4 is hollow and forms the air circulation section 9. In addition, an annular projection 7 is formed on the hand side and air circulation holes 8*a* and 8*b* connected with the air circulation section 9 open above and below the annular projection 7. The distance between the air circulation hole 8*a* and the air circulation hole 8*b* as small as possible, for example, about 1 to 3 cm, and particularly 0.5 to 1 cm, is preferable.

The under surface of the annular projection 7 is preferably designed to be closely attached to the upper surface of the scraping section 6 when the lid body is completely closed so that the inside of the container body 2 may be maintained airtight and the unnecessary cosmetic composition A may not remain.

When the container with an applicator 1 of the present invention is not used, the container is maintained airtight by the sealing at the mouth of the container body 2 as shown in FIG. 1. If the mouth is opened, the lid body 3 is elevated as shown in FIG. 2. As the result, the shaft body 4 is also elevated and the inside of the container body 2 is brought to a state of reduced pressure. Since the shaft body 4 is closely in contact with the scraping section 6 in this state, air from the air circulation hole 8*b* above the annular projection 7 passes through the air circulation section 9 and flows into the inside of the container body 2 via the air circulation hole 8*a* below the annular projection 7. In this instance, when the cosmetic composition A leaks into the air circulation section 9, the leaked composition is returned to the container body 2 together with the air.

On the other hand, when the lid is closed after use, the shaft body 4 is inserted into the container body 2 starting from the applicator 5 as shown in FIG. 3, whereby the pressure inside the container body 2 is increased. As a result, immediately before sealing, the air passes through the air circulation hole 8*a* located below the scraping section 6 to the air circulation section 9 and the air circulation hole 8*b*. Even if there is leaked cosmetic composition A in the air circulation section 9, the composition A returns to the container body when the lid is opened as mentioned above. Therefore, the cosmetic composition A is not ejected from the air circulation hole 8*b* together with air.

The container with an applicator 1 of the present invention is characterized by (i) having the air circulation section 9 and the air circulation holes 8*a* and 8*b* connected therewith and (ii) the location relationship of the air circulation holes 8*a* and 8*b*, i.e. the air circulation hole 8*a* is below the annular projection 7 and the air circulation hole 8*b* is above the annular projection 7. Otherwise, the container is the same as conventional containers with an applicator.

The applicator 5, for example, is not limited to the brush as shown in the Figure, but may be a rigid or elastic body that can apply the content in the shape of a sphere, ellipsoidal sphere, a cylinder with a circular or ellipsoidal cross-section (with the shape of the tip being not limited, but including a sphere, plane, and slanting plane), a circular truncated cone, a spatula, a screw, a comb, or the like, including those of which the surface is electrostatically flocked. The material may be any material including metals, plastics such as nylon and Duracon, and elastomers such as polyurethane and polyester. The container 2 is also not limited to a cylinder, but may be a column with a polygonal cross-section such as a quadrangular prism. The material may be a transparent or translucent glass, plastic, and the like or may be an opaque material such as a metal. Furthermore, the form of the scraping section 6 is not limited to that integrated with the seal of the mouth as shown in the Figure, but may be a form integrated with the container or may have a ring-like member inserted therein.

Next, another embodiment of the container with an applicator of the present invention is shown in FIG. 6, wherein 6 is a scraping section, 7 is an annular projection, 8 is an air circulation hole, 9 is an air circulation section, 11 is a slide initiation section, 12 is a sliding section, 13 is a container body mouth, and 14 is a space.

In the embodiment of FIG. 6, the diameter of the annular projection 7 is greater than the internal diameter of the sliding section 12 and the sliding section 12 is provided with elasticity, whereby the annular projection 7 comes more closely in contact with the sliding section 12, thereby increasing the sealing performance of the mouth. In addition, the sealing performance and the function of pushing forward the cosmetic composition A adhering to the shaft body 4 are increased by providing the air circulation hole 8*a* in a position such that the air circulation 8*a* is separated from the sealing by the scraping section 6 when the annular projection 7 comes in contact with the slide initiation section 11.

Although the diameter of the annular projection 7 in FIG. 6 is greater than the internal diameter of the sliding section 12, the difference is not so great that the sliding action of the annular projection 7 itself is inhibited. Appropriate bending of the sliding section 12 according to the sliding movement of the annular projection 7 ensures that the annular projection 7 slides while keeping in intimate contact with the sliding section 12. The bending of the sliding section 12 can be achieved by, for example, as in the present embodiment, decreasing the thickness of the sliding section by removing the back of the sliding section 12 (i.e. by cutting the periphery), thereby forming a space 14, preferably, between the inside of the container body mouth 13 (only one side is shown) and the outside of the sliding section 12 to increase elasticity, and by forming the sliding section 12 from a material with elasticity such as a rubber.

The effect of each section in this embodiment will be described in more detail with reference to FIG. 5. FIG. 5 a to c are partially broken views of a (cylindrical) container with an applicator of the present invention, showing a series of states from the state in which the lid is closed through the state in which the lid is opened, and d to g are partially broken views showing a series of states from the state in which the lid is opened through the state in which the lid is closed.

The air circulation hole 8*a* is formed in a location such that the air circulation hole 8*a* is separated from the sealing by the scraping section 6 when the annular projection 7 comes in contact with the slide initiation section 11 as shown in FIG. 6. Specifically, as shown in FIG. 5*d*, the air circulation hole 8*a* is formed in a location such that, in an operation for housing the lid body 3 into the container body 2, the air circulation hole 8*a* is separated from the sealing by the scraping section 6 and is positioned within the container body 2 at the time when the annular projection 7 is just pushed down to the location in which the annular projection 7 comes in contact with the slide initiation section 11. Here, as mentioned above, the length of the air circulation section 9, i.e., the distance between the air circulation hole 8*a* and the air circulation hole 8*b*, is preferably as small as possible in order to increase the pressure difference of the inside and outside of the container due to opening and closing the lid body. In addition, the air circulation hole 8*a* is preferably in the above-described position because of the following reason.

Specifically, when the lid is closed after use, the shaft body 4 is inserted into the container body 2 starting from the applicator 5. In this instance, since the shaft body 4 and the scraping sections 6 are sealed, the pressure inside the container body 2 is gradually increased. As a result, the cosmetic composition A adhering to the shaft body 4 is accumulated in the sliding section 12 due to the sealing by the scraping section 6.

Because the air circulation hole 8*a* is separated from the sealing by the scraping section 6 when the shaft body 4 is inserted into the container body 2 to the point at which the annular projection 7 comes in contact with the slide initiation section 11 (see FIG. 5*d*), pressurized air in the container body 2 passes from the air circulation hole 8*a* to the outside via the air circulation section 9 and the air circulation hole 8*b*. Since the inside of the container body 2 communicates with the outside by the air circulation section 9 at this point in time, the container body 2 is maintained at the normal pressure until the time when the container body 2 is completely sealed by the lid body 3 by insertion of the shaft body 4 into the container body 2.

On the other hand, in the course of insertion of the shaft body 4 into the container body 2 during which the annular projection 7 moves from the slide initiation section 11 to the sliding section 12 until the annular projection 7 comes in contact with the scraping section 6, as shown in FIGS. 5*d* to 5*g*, the space between the annular projection 7 and the scraping section 6 changes from normal pressure to a pressurized state due to the sealing by the annular projection 7 and the sealing by the scraping section 6. As a result, since the degree of close attachment of the annular projection 7 to the sliding section 12, i.e. the degree of sealing, is increased as mentioned above, the pressurized air is pushed into the container body 2 under normal pressure together with the cosmetic composition A accumulated in this space.

As mentioned above, the sliding section 12 is smoothly slid by the annular projection 7 and the function of pushing the cosmetic composition A into the container body 2 is increased in this embodiment by forming the air circulation hole 8*a* at the location at which the air circulation hole 8*a* is separated from the sealing by the scraping section 6 when the annular projection 7 comes in contact with the slide initiation section 11.

In addition, in this embodiment, in order to reduce the amount of the cosmetic composition A which is leaked out into the air circulation section 9 via the air circulation hole 8*a*, the diameter of the air circulation hole 8*a* is preferably equivalent to or smaller than the diameter of the air circulation hole 8*b*. For example, when the diameter of the air circulation hole 8*b* is about 0.8 to 1.0 mm, the diameter of the air circulation hole 8*a* is preferably about 0.5 to 0.8 mm.

Moreover, in this embodiment, in order to secure the strength of the shaft body 4, the shaft body is not only provided with a large diameter, particularly, around the area in which the air circulation holes are formed, but is also provided with a shape with only a small constriction.

The container with an applicator 1 of the present invention can be used as a container for filling various viscous solutions. The container is used with an advantage particularly for highly viscous makeup cosmetic compositions such as mascara, a liquid eyeliner, a paste-like lipcolor, a paste-like lip gloss, and manicure material.

In the present invention, the problem of ejecting residue produced from the composition adhering to the scraping section from the container mouth has been overcome by providing a short air circulating passage. Specifically, the pressure difference produced between the inside and the outside of the container by opening and closing operations of the lid body is comparatively large due to the short air circulation section, whereby the pressure required for returning to the container the cosmetic composition leaked during storage can be obtained without fail.

Moreover, since the container has a passage (the air circulation hole 8*a*, air circulation section 9, and air circulation hole 8*b*) which cancels the pressure difference between the inside and outside of the container in this manner, the cosmetic composition does not spout from the clearance between the shaft body and the scraping section.

On the other hand, when the air circulation section is long, it is difficult to completely return the cosmetic composition leaked during storage because of a small pressure change per a fixed amount of volume change. Therefore, some countermeasure is required.

EXPLANATION OF SYMBOLS

Figure 1:
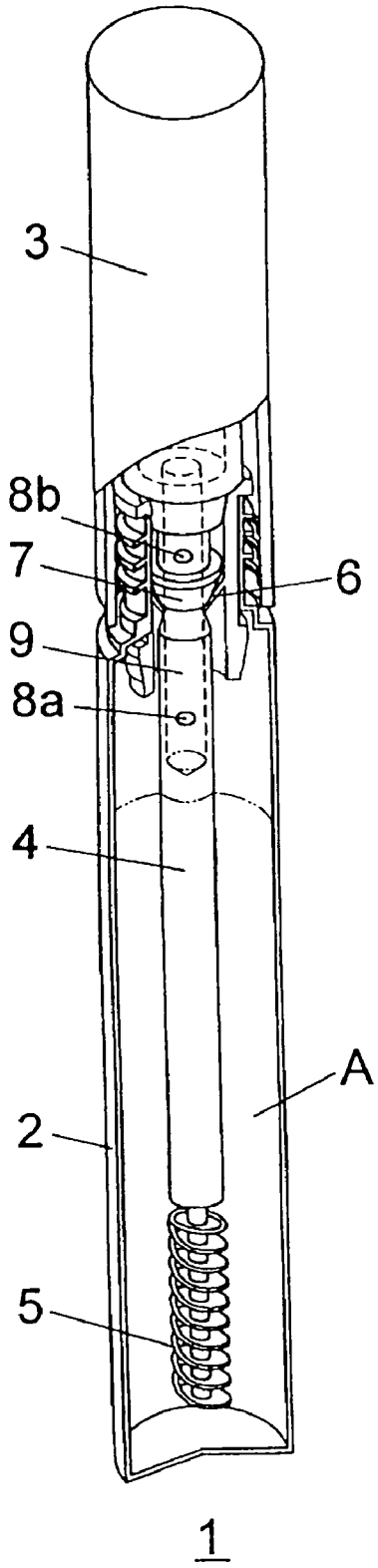
FIG. 1 is a partially broken view of a container with an applicator of the present invention, in a state in which the lid is closed.
Figure 2:
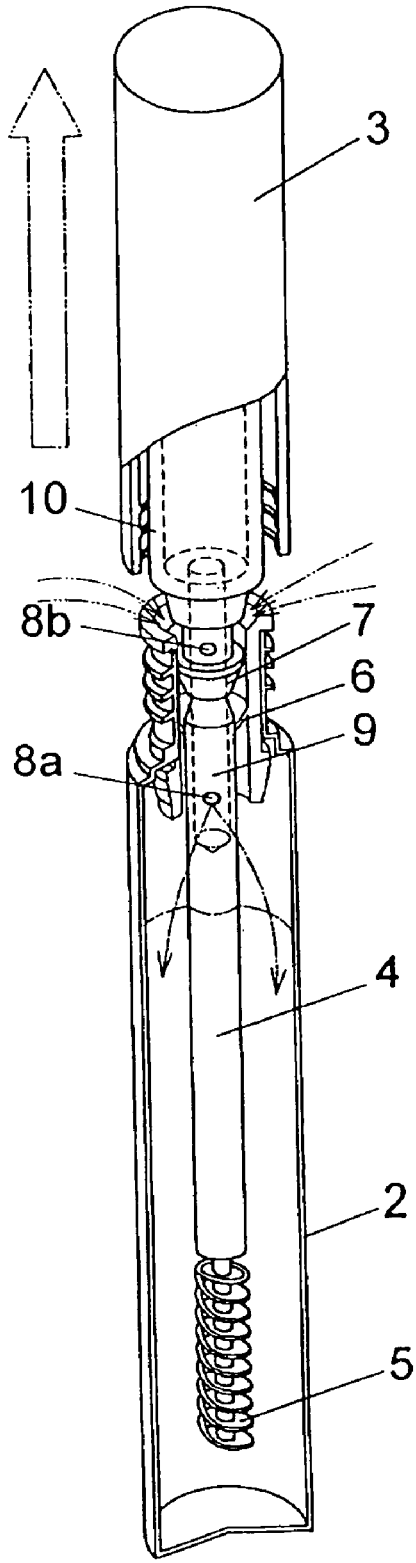
FIG. 2 is a partially broken view of a container with an applicator of the present invention, in a state in which the lid is being opened.
Figure 3:
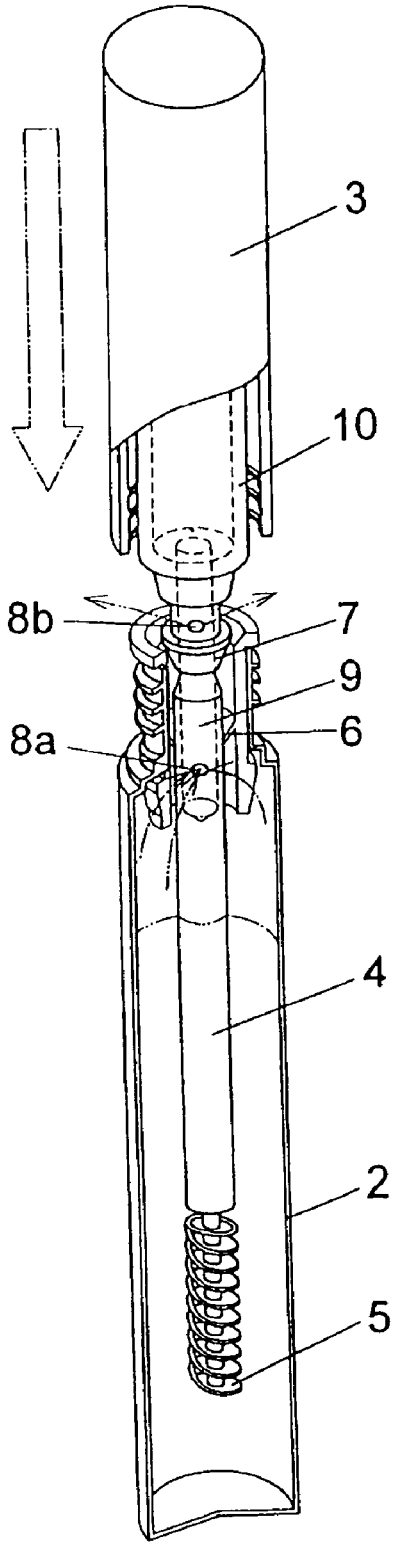
FIG. 3 is a partially broken view of a container with an applicator of the present invention, in a state in which the lid is being closed.
Figure 4:
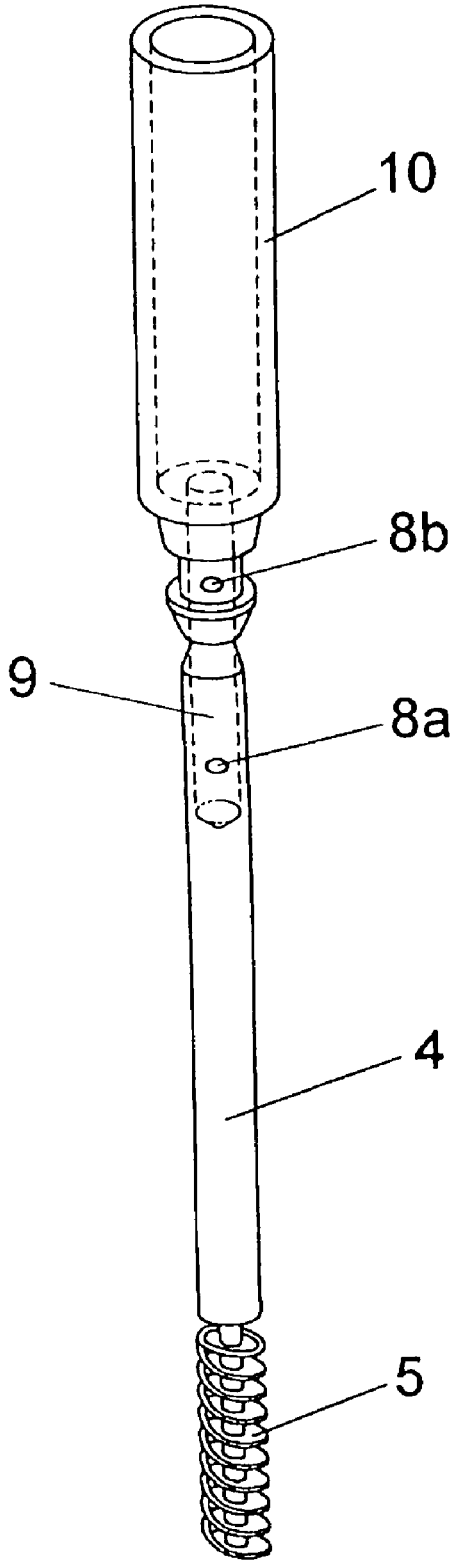
FIG. 4 is a drawing showing a securing part and a shaft body to be secured to the lid body.
Figure 5:
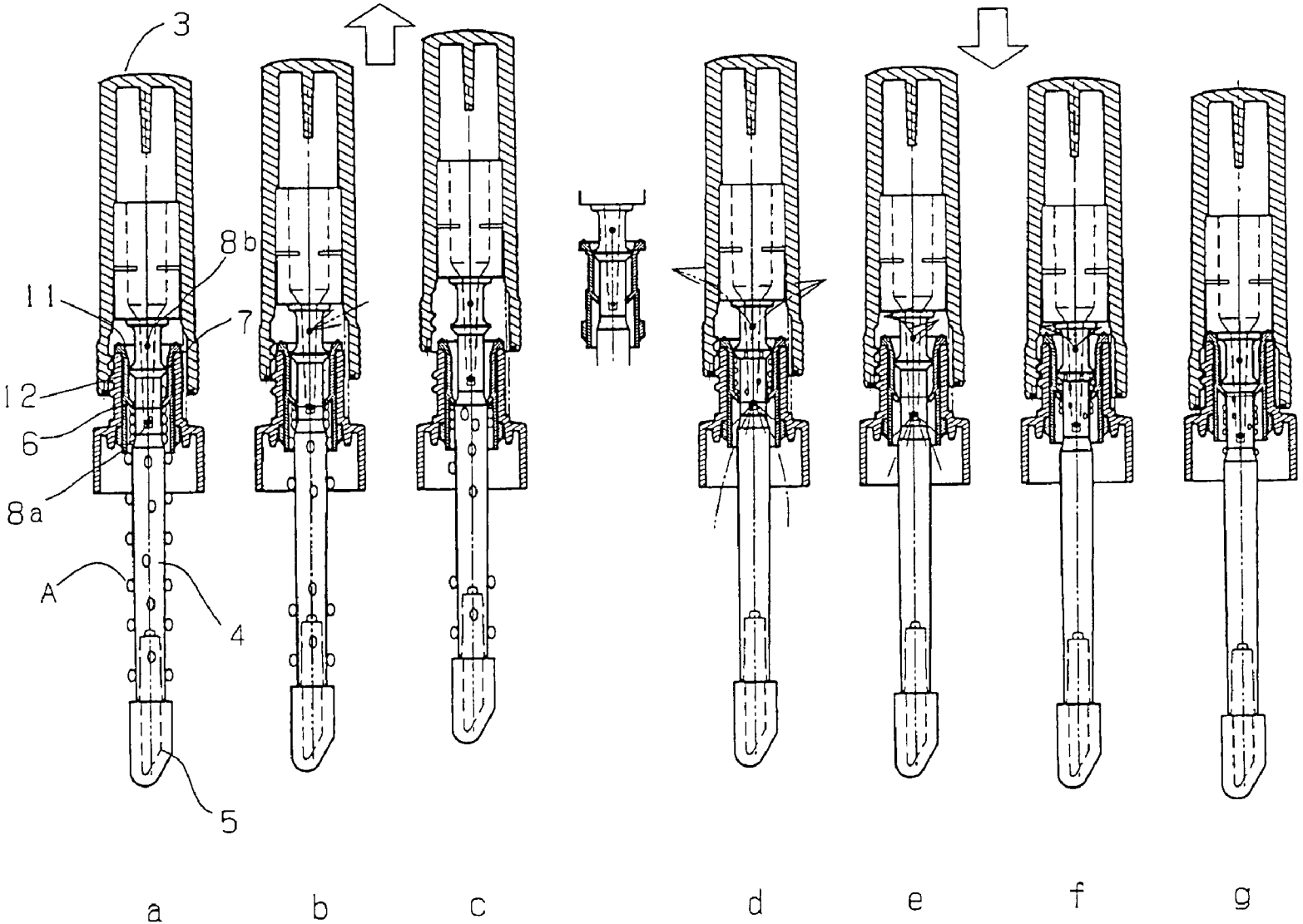
FIG. 5 is a drawing of a container with an applicator of the present invention, showing a series of states from the state in which the lid is closed through the state in which the lid is opened.
Figure 6:
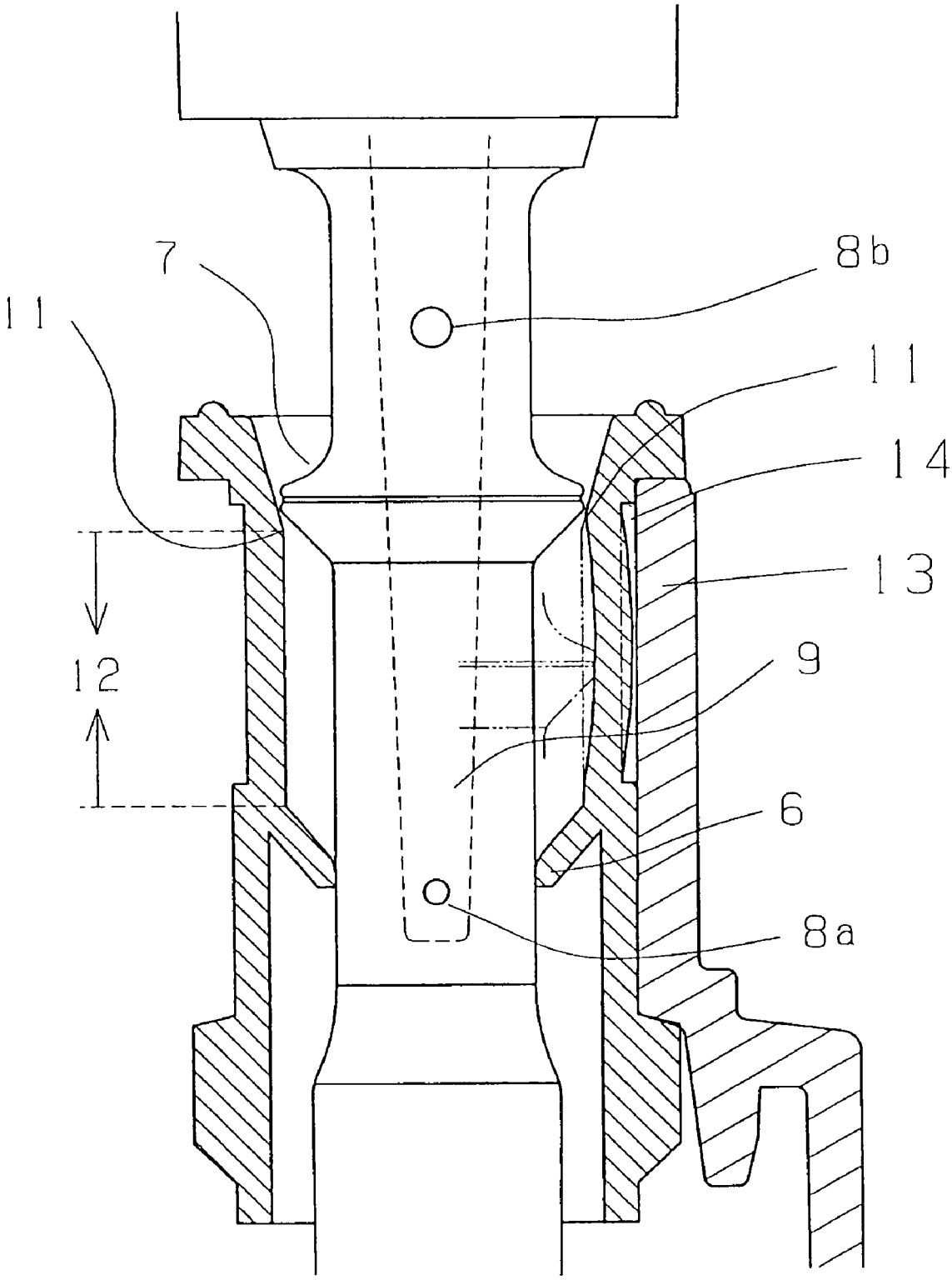
FIG. 6 is a partially broken view of a container with an applicator of the present invention, in a state in which the annular projection comes in contact with the slid initiation section.

1: Container with an applicator
2: Container body
3: Lid body
4: Shaft body
5: Applicator
6: Scraping section
7: Annular projection
8: Air circulation holes
9: Air circulation section
10: Securing part
11: Slide initiation section
12: Sliding section
13: Container body mouth
14: Space
A: Cosmetic composition

The invention claimed is:

1. A container with an applicator comprising:

a container body;

a lid body having a shaft body with an applicator provided on a top end thereof;

a scraping section provided inside of a mouth of the container body, an annular projection provided on the shaft body of the lid body;

small air circulating holes provided above and below the annular projection of the shaft body, enabling air to circulate through the inside of the shaft body; and a sliding section with elasticity on an upper side face of the scraping section, wherein the air circulation hole formed below the annular projection is provided in a location such that the air circulation hole is separated from a sealing by the scraping section and is positioned within the container body when the annular projection is pushed down to a location in which the annular projection comes in contact with a slide initiation section.

2. The container with an applicator according to claim 1, wherein the annular projection intimately comes in contact with the scraping section when the lid body is completely closed.

3. The container with an applicator according to claim 2, wherein the bottom of the annular projection of the shaft body is in a form of an inverted circular truncated cone.

4. The container with an applicator according to claim 3, wherein the thickness of the sliding section is decreased by removing the back of the sliding section, thereby forming a space between the inside of the container body mouth and the outside of the sliding section.

5. The container with an applicator according to claim 2, wherein the thickness of the sliding section is decreased by removing the back of the sliding section, thereby forming a space between the inside of the container body mouth and the outside of the sliding section.

6. The container with an applicator according to claim 2, wherein the diameter of the air circulation hole formed below the annular projection is equivalent to or smaller than the diameter of the air circulation hole formed above the annular projection.

7. The container with an applicator according to claim 2, wherein the diameter of the annular projection is greater than the internal diameter of the sliding section.

8. The container with an applicator according to claim 1, wherein the bottom of the annular projection of the shaft body is in a form of an inverted circular truncated cone.

9. The container with an applicator according to claim 8, wherein the thickness of the sliding section is decreased by removing the back of the sliding section, thereby forming a space between the inside of the container body mouth and the outside of the sliding section.

10. The container with an applicator according to claim 8, wherein the diameter of the air circulation hole formed below the annular projection is equivalent to or smaller than the diameter of the air circulation hole formed above the annular projection.

11. The container with an applicator according to claim 8, wherein the diameter of the annular projection is greater than the internal diameter of the sliding section.

12. The container with an applicator according to claim 1, wherein the thickness of the sliding section is decreased by removing the back of the sliding section, thereby forming a space between the inside of the container body mouth and the outside of the sliding section.

13. The container with an applicator according to claim 12, wherein the diameter of the air circulation hole formed below the annular projection is equivalent to or smaller than the diameter of the air circulation hole formed above the annular projection.

14. The container with an applicator according to claim 12, wherein the diameter of the annular projection is greater than the internal diameter of the sliding section.

15. The container with an applicator according to claim 1, wherein the diameter of the air circulation hole formed below the annular projection is equivalent to or smaller than the diameter of the air circulation hole formed above the annular projection.

16. The container with an applicator according to claim 15, wherein the diameter of the annular projection is greater than the internal diameter of the sliding section.

17. The container with an applicator according to claim 1, wherein the diameter of the annular projection is greater than the internal diameter of the sliding section.

* * * * *